US007975543B2

(12) United States Patent
Clem et al.

(10) Patent No.: US 7,975,543 B2
(45) Date of Patent: Jul. 12, 2011

(54) METHOD FOR CARRYING OUT ISOMETRIC EXERCISE REGIMEN

(75) Inventors: William E. Clem, Bozeman, MT (US); Richard Rae Clem, Tigard, OR (US); Thomas J. Wernikowski, Bozeman, MT (US); Joachim Eldring, Bozeman, MT (US); Nathaniel Longstreet, Boise, ID (US); Steven Wood, Eagle, ID (US); Seth Huckstead, Boise, ID (US)

(73) Assignee: CardioGrip IPH, Inc., Boise, ID (US)

( * ) Notice: Subject to any disclaimer, the term of this patent is extended or adjusted under 35 U.S.C. 154(b) by 0 days.

(21) Appl. No.: 12/819,112

(22) Filed: Jun. 18, 2010

(65) Prior Publication Data

US 2010/0255957 A1 Oct. 7, 2010

Related U.S. Application Data

(60) Continuation of application No. 12/319,866, filed on Jan. 12, 2009, now Pat. No. 7,739,910, and a division of application No. 11/634,834, filed on Dec. 5, 2006, now Pat. No. 7,699,757.

(51) Int. Cl.
*A61B 5/22* (2006.01)

(52) U.S. Cl. ..... 73/379.02

(58) Field of Classification Search ..... 73/379.02, 73/379.03; 128/774; 600/486
See application file for complete search history.

(56) References Cited

U.S. PATENT DOCUMENTS 2,837,334 A 6/1958 Long
4,632,383 A 12/1986 Tsuzuki
4,842,273 A 6/1989 Schmeiss
4,878,384 A 11/1989 Bruhn
4,886,073 A 12/1989 Dillon et al.
4,949,729 A * 8/1990 Haski ..... 600/587
5,226,650 A 7/1993 Suttner
5,398,696 A * 3/1995 Wiley ..... 600/587
(Continued)

FOREIGN PATENT DOCUMENTS

DE 30 38 724 A1 5/1982

OTHER PUBLICATIONS

Delp, M. et al., "Integrated control of the skeletal muscle microcirculation in the maintenance of arterial pressure during excercise," J Appl Physiol 97:1112-1118, 2004, available at jap.physiology.org (last visited Feb. 13, 2007).

(Continued)

*Primary Examiner* — Jewel Thompson
(74) *Attorney, Agent, or Firm* — Duane Morris LLP

(57) ABSTRACT

A method for isometric exercise safely reduces resting blood pressure and increases overall cardiovascular health. The method utilizes an apparatus that provides resistance to force and maximizes user/patient comfort. The handle or grip of the apparatus may be squeezed with a force less than the maximum squeeze force of the user, thereby restricting blood flow through contracting muscles and safely increasing blood pressure during exercise. Resting blood pressure is reduced through use of the method. The restricted blood flow reduces localized necrosis due to obstruction of blood supply. The method includes measuring and recording the maximum squeeze force of a user, calculating a fractional force using the duration of exercise or a desired fractional force percentage, and inducing the user to apply the fractional force, a lesser fractional force or no force for a time.

25 Claims, 14 Drawing Sheets

U.S. PATENT DOCUMENTS

| | | | | |
|---|---|---|---|---|
| 5,597,373 | A * | 1/1997 | Bond et al. | 482/4 |
| 5,643,138 | A | 7/1997 | Huang | |
| 5,662,123 | A * | 9/1997 | Goldman | 600/595 |
| 5,720,711 | A * | 2/1998 | Bond et al. | 601/23 |
| 5,904,639 | A | 5/1999 | Smyser et al. | |
| 6,086,518 | A | 7/2000 | MacCready, Jr. | |
| 6,324,557 | B1 | 11/2001 | Chan | |
| 6,662,651 | B1 | 12/2003 | Roth | |
| 6,702,720 | B2 | 3/2004 | Dardik | |
| 6,811,536 | B2 | 11/2004 | Sun et al. | |
| 6,962,569 | B2 | 11/2005 | Smyser et al. | |
| 7,470,217 | B2 | 12/2008 | Jones-Glaser | |
| 2005/0219355 | A1 | 10/2005 | Tahara | |
| 2006/0035762 | A1 | 2/2006 | Smyser et al. | |
| 2006/0064042 | A1 | 3/2006 | Smyser et al. | |
| 2006/0122036 | A1 | 6/2006 | Ferrara | |
| 2006/0217243 | A1 | 9/2006 | Feldman | |

OTHER PUBLICATIONS

DeSouza, C. et al., "Regular Aerobic Exercise Prvents and Restores Age-Related Declines in Endothelium-Dependent Vasodilation in Healthy Men," Circulation 102:1351-1357, 2000, available at http://circ.ahajournals.org/cgi/content/full/102/12/1351 (last visited Feb. 13, 2007).

DiBona, G., "The Sympathetic Nervous System and Hypertension: Recent Developments," Hypertension 43:147-150, 2004, available at http://hyper.ahajournals.org/cgi/content/full/43/2/147 (last visited Feb. 13, 2007).

Dinenno, F. et al., "Regular endurance exercise induces expansive arterial remodelling in the trained limbs of healthy men," J Physiol 534:287-295, 2001, available at http://jp.physoc.org/cgi/content/full/534/1/287 (last visited Feb. 13, 2007).

Green, D. et al., "Effect of exercise training on endothelium-derived nitric oxide function in humans," J Physiol 561.1:1-25, 2004.

Hornig, B. et al., "Physical Training Improves Endothelial Function in Patients With Chronic Heart Failure," Circulation 93:210-214, 1996, available at http://www.circ.ahajournals.org/cgi/content/full/93/2/210 (last visited Mar. 13, 2007).

Jungersten, L. et al., "Both physical fitness and acute exercise regulate nitric oxide formation in healthy humans," J Appl Physiol 82(3):760-764, 1997.

Kamiya A. et al., "Static handgrip exercise modifies arterial baroreflex control of vascular sympathetic outflow in humans," Am J Physiol Regulatory Integrative Comp Physiol 281:R1134-R1139, 2001.

Katz, S. et al., "Training improves endothelium-dependent vasodilation in resistance vessels of patients with heart failure," J Appl Physiol 82(5):1488-1492, 1997.

Linke, A. et al, "Endothelial Dysfunction in Patients With Chronic Heart Failure: Systemic Effects of Lower-Limb Exercise Training," J Am Coll Cardiol 37(2):392-397, 2001, available at http://content.onlinejacc.org/cgi/content/full/37/2/392 (last visited Feb. 13, 2007).

MacDonald, J. et al., "Hypotension following mild bouts of resistance exercise and submaximal dynamic exercise," Eur J Appl Physiol 79:148-154, 1999.

Maiorana, A. et al., "The Effect of Combined Aerobic and Resistance Exercise Training on Vascular Function in Type 2 Diabetes," J Am Coll Cardiol 38(3):860-866, 2001, available at http://content.onlinejacc.org/cgi/content/full/38/3/860 (last visited Feb. 13, 2007).

McGowan, C. et al., "Acute Vascular Responses to Isometric Handgrip (IHG) Exercise and the Effects of Training in Persons Medicated for Hypertension," Am J Physiol Heart Circ Physiol 291:H1797-H1802, 2006 (in Press, 29 pages).

McGowan, C. et al., "Isometric Handgrip training Improves Blood Pressure and Endothelial Function in Persons Medicated for Hypertension," Abstract of Presentation, American Physiological Society Intersociety Meeting, Austin, Texas, Oct. 2004, one page.

McGowan, C. et al., "Isometric handgrip trianing improves local flow-mediated dilation in medicated hypertensives," Eur J Appl Physiol 99(3):227-234, 2006.

Mostoufi-Moab, S. et al., "Forearm training reduces the exercise pressor reflex during ischemic rhythmic handgrip," J Appl Physiol 84:277-283, 1998, available at jap.physiology.org (last visited Feb. 13, 2007).

Peters, P. et al., "Short-term isometric exercise reduces systolic blood pressure in hypertensive adults: Possible role of reactive oxygen species (R1)," International J. of Cardiology 110(2):199-205, 2005 (in Press, 7 pages).

Ray, C. et al., "Isometric handgrip training reduces arterial pressure at rest without changes in sympathetic nerve activity," Am J Physiol Heart Circ Physiol 279:H245-H249, 2000, available at ajpheart.physiology.org (last visited Mar. 11, 2005).

Taylor, A et al., "Isometric Training Lowers Resting Blood Pressure and Modulates Autonomic Control," Medicine & Science in Sports & Exercise 35(2):251-256, 2003.

Visocchi, A. et al., "The Effect of Isometric Arm or Leg Exercise on Resting Blood Pressure and Arterial Distensibility in Persons Medicated For Hypertension," Abstract of Presentation, American Physiological Society Intersociety Meeting, Austin, Texas, Oct. 2004, one page.

Wiley, R. et al., "Isometric exercise training lowers resting blood pressure," Medicine & Science in Sports & Exercise 24(7):749-754, 1992.

Supplementary European Search Report from EP07862541.5 dated May 8, 2010 for PCT/US2007/024903 based on U.S. Appl. No. 11/634,834 of the present application.

Notification of Transmittal of the International Search Report and the Written Opinion of the International Searching Authority, or the Declaration dated Nov. 24, 2008 for PCT/US2007/024903 based on U.S. Appl. No. 11/634,834.

* cited by examiner $F_G$: Grip force applied to back movable member
$F_P$: System related preload
$B_l$: Lower bumper
$B_c$: Center bumper
$B_u$: Upper bumper
$F_{Bl}$: Force transferred through lower bumper
$F_{Bu}$: Force transferred through upper bumper
$F_S$: Force transferred to sensor

METHOD FOR CARRYING OUT ISOMETRIC EXERCISE REGIMEN

CROSS REFERENCE TO RELATED APPLICATIONS

This application is a continuation application of pending U.S. application Ser. No. 12/319,866, entitled System and Method For Carrying Out Protocol-Based Isometric Exercise Regimen, filed Jan. 12, 2009, which is a divisional application of U.S. application Ser. No. 11/634,834, entitled Apparatus, System and Method For Carrying Out Protocol-Based Isometric Exercise Regimen, filed Dec. 5, 2006, now U.S. Pat. No. 7,699,757, the contents of each of which are herein incorporated by reference as if set forth in their entireties.

FIELD OF INVENTION

The present invention relates to the field of cardiovascular health and more particularly to a system and method for safely reducing the resting blood pressure (both systolic and diastolic pressures) of humans, especially hypertensive humans, modulating the autonomic nervous system and generally improving cardio vascular health in humans.

BACKGROUND OF INVENTION

U.S. Pat. No. 5,398,696 to Wiley (the '696 patent) discloses a protocol or method for lowering the resting systolic and diastolic blood pressures of patients. This protocol commences with a determination of the maximal isometric force which can be exerted by a patient with any given muscle (e.g., skeletal muscle or group of muscles) of such patient. The determined maximal isometric force is recorded. The patient, then, is periodically permitted to intermittently engage in isometric contraction of the given muscle at a fractional level (e.g., up to about 60%) of the maximal force determined for a given contraction duration followed by a given resting duration. A perceptible indicia correlative to an output signal generated in response to isometric force exerted by the given muscle is displayed to the patient so that the patient can sustain the given fractional level of maximal force. The perceptible indicia can comprise of a visual display, an audio signal, or a tactile signal for example. The tactile signal may comprise of a vibration and a feedback force.

The '696 patent further discloses an apparatus for use by a patient in carrying out the foregoing protocol. This apparatus includes the dynamometer for a patient to activate with a given muscle (e.g., skeletal muscle or group of muscles). A memory is connected to the dynamometer for recording the maximal isometric force which can be exerted by the patient with any given muscle of that patient. A display is connected to the dynamometer and to the memory for displaying percentages of the recorded maximal isometric force when the patient activates the dynamometer with the given muscle. A timer is provided for the patient to ascertain the duration over which the given muscle exerts isometric force through the dynamometer and the duration between exertions. The '696 patent is herein incorporated by reference in its entirety.

U.S. Pat. No. 5,904,639 to Smyser (the '639 patent) discloses a protocol-configurable isometric hand grip recording dynamometer with user guidance. The apparatus employs a grip within which is mounted a load cell. The load cell, in turn, is coupled to a rigid printed circuit board which is compressively squeezed during an exercise regimen. A readout is integrally formed with the battery operated system to provide aural and visual cuing at an angle facilitating the user's reading of a display. Visual cues are provided at the display throughout an exercise regimen prompting the user as to which hand to use and the amount of compressive squeezing force to be applied. The system and method includes a technique for scoring the efforts of the user. The microprocessor-driven device includes archival memory and a data communications port that may be employed interactively with a trainer or physician. The '639 patent is herein incorporated by reference in its entirety.

SUMMARY OF INVENTION

The preferred embodiment of present invention relates to a compact, lightweight, hand-held, battery powered, isometric exercise apparatus which exhibits a structural configuration enabling it to be subjected to loads induced by the isometric contraction of a muscle or muscle group. The apparatus comprises a system where contraction of a muscle or muscle group causes a measurable indicia to the force measuring component, which then communicates the measured force to the control system which uses said force to provide performance information to the user. More specifically, the apparatus is designed to allow natural resistance to force, reducing strain, and increasing the total area of skin surface which is compressed during use. The design allows greater user comfort during the performance of isometric exercise. Additionally, the apparatus is designed to communicate the exercise parameters and other pertinent related data to remote devices such as stand alone computers, personal digital assistants, laptops, servers, and routers, as examples.

Extending from the handle or grip is a display, with a power button juxtaposed to the display. The display is mounted such that the user can observe visual cues while carrying out an isometric exercise protocol. Further, the display provides a menu of options of exercise regimens that a user can select at the beginning of each use of the apparatus. The control system incorporated within the apparatus is processor driven and is capable of recording the maximum isometric squeeze force (MSF) exerted by a user, as well as other user data necessary for guiding the user in performance of isometric exercise. The display displays the percentage of the recorded MSF the user is to exert during the exercise regimen (the fractional force). A clock is provided for the user to ascertain the amount of time the user is to hold the fractional force and the duration between exertions. The amount of time available for an exercise can be inputted.

The system and method associated with the preferred embodiment of the apparatus provide visual and audible cues to the user and additionally, through the utilization of a scoring technique, provide user performance data for training or exercise management purposes. Visual cues not only guide the user through a multi-step protocol designed to lower blood pressure levels, but also aid the user in maintaining set target isometric contraction levels. For instance, during an exercise regimen, the display indicates the target force desired. When the handle or grip is squeezed either below the target force or beyond the target force, the user is provided with an aural and/or visual warning. Further, when the user exerts a maximum squeeze force (MSF), the display gives the user visual information as to the relative value of such MSF. The apparatus may also be custom programmed for individual users who choose either a set time period for an exercise regimen or a defined level of exertion, i.e., a set fractional amount of the MSF, for an exercise regimen. The apparatus may also be used as a form of physical therapy or group of physical therapies (i.e., variable therapies and variable forces). According to a preferred embodiment, the apparatus of the present invention is generally programmed to carry out an exercise regimen that lowers the resting systolic and diastolic blood pressures of users.

The present invention is also directed to a method for lowering the resting systolic and diastolic blood pressures of users as well as providing a protocol for increasing parasympathetic nerve activity and improving peripheral artery function. The protocol also adds to a person's nitric oxide production.

This method begins with a determination of the maximal isometric squeeze force (MSF) which can be exerted by the user with any given muscle, preferably the hand muscles. The MSF is recorded. The user is then periodically asked to intermittently engage in isometric contraction of the given muscle at a fractional level, from about 15% to about 55%, of the MSF for a given contraction duration (T) followed by a given resting duration (RSF). According to a preferred embodiment, the RSF is zero. According to another embodiment, the RSF is not zero. A perceptible indicia correlative to an output signal generated in response to an isometric force exerted by the given muscle is displayed to the user so that the user can sustain the given fractional level of maximal force for the desired duration (T). This method may also allow for the dynamic change of the MSF, FSF (fractional squeeze force), RSF, or T during a performance of an exercise.

A representative procedure for a user to follow includes the user exerting a squeezing force with either hand equal to about 30% of the MSF and holding that about 30% force for two minutes; resting for one minute with an RSF of zero; exerting a force with the other hand equal to about 30% of the MSF for two minutes; resting one minute with an RSF of zero; exerting a force of about 30% of maximum for two minutes again with the first hand; resting one minute with an RSF of zero; and exerting a force of about 30% for two minutes again with the second hand. This completes the isometric exercise for that day. The same procedure should be followed by the user/patient at least three days per week.

Advantages of the present invention include recognition that isometric exercise is an effective means for a patient to lower both resting systolic and diastolic blood pressure. Another advantage of the present invention is that lowering resting blood pressure can be achieved utilizing isometric contractions far short of maximal force. Isometric contractions at maximum force could cause blood pressure to rise to dangerous levels, especially in hypertensive patients. Yet another advantage is an isometric exercise regimen that takes but a few minutes a day and yet is effective in lowering the user's resting blood pressure. A further advantage is an apparatus which has been designed to implement the isometric exercise regimen disclosed herein.

There has thus been outlined, rather broadly, the more important features of the invention in order that the detailed description thereof that follows may be better understood, and in order that the present contribution to the art may be better appreciated. There are, of course, additional features of the invention that will be described further hereinafter.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception upon which this disclosure is based may be readily utilized as a basis for the designing of other structures, methods and systems for carrying out the several purposes of the present invention. It is important, therefore, that equivalent constructions, insofar as they do not depart from the spirit and scope of the present invention, are included in the present invention.

For a better understanding of the invention, its operating advantages and the aims attained by its uses, references should be had to the accompanying drawings and descriptive matter which illustrate preferred embodiments of the invention.

DETAILED DESCRIPTION OF PREFERRED EMBODIMENTS

Figure 1A:
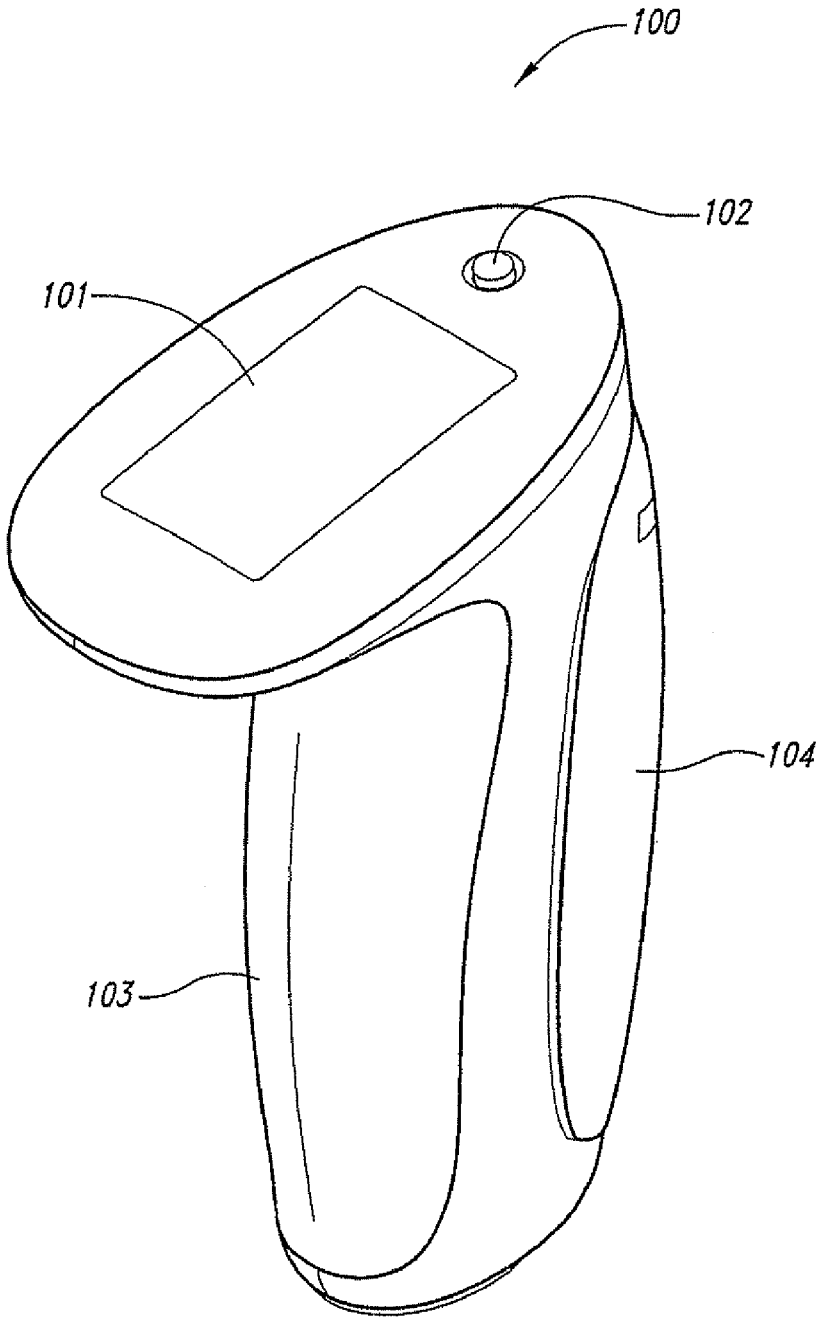
FIG. 1*a* is a perspective view of the apparatus according to a preferred embodiment of the invention.
Figure 1B:
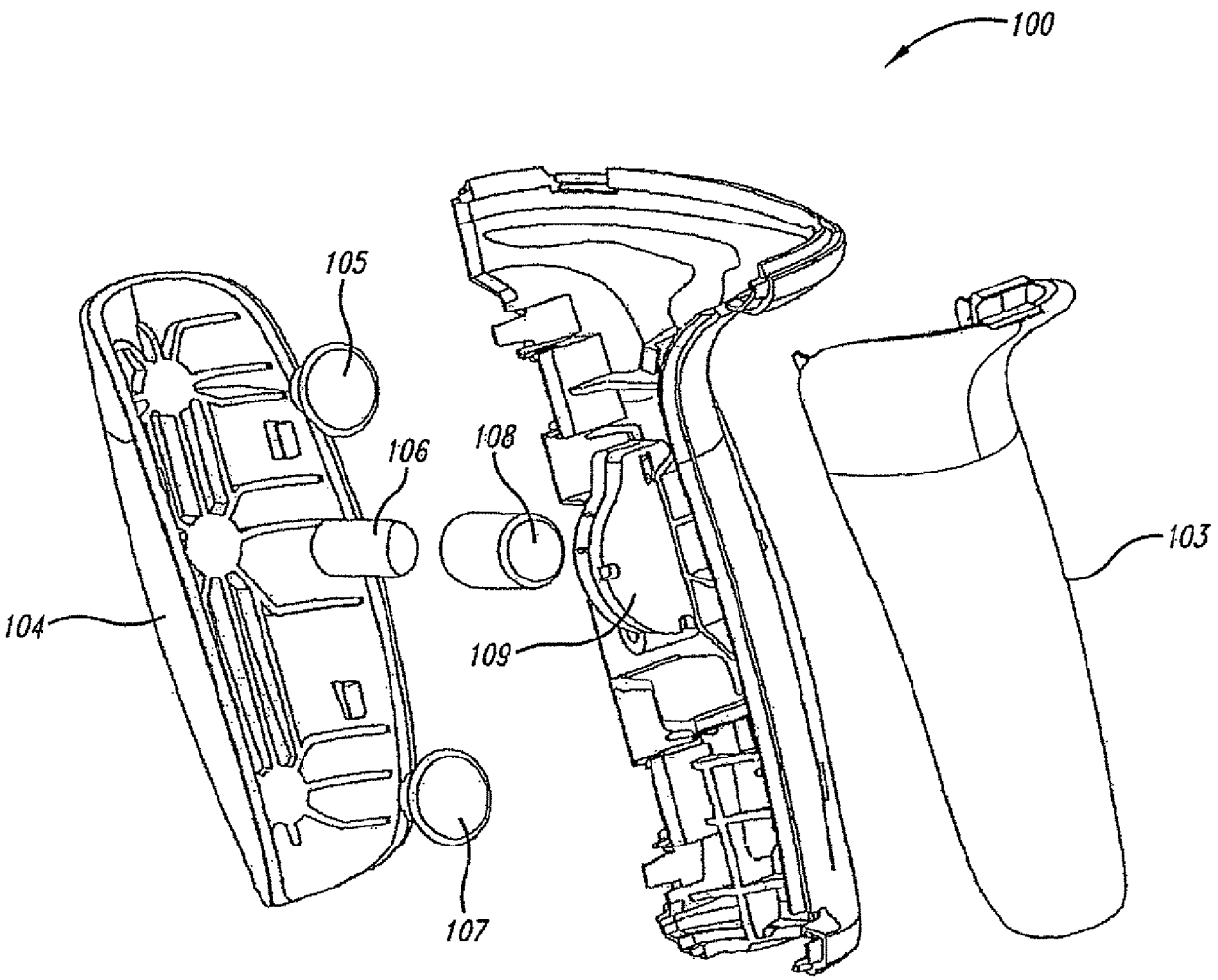
FIG. 1*b* is an exploded perspective view of the apparatus of FIG. 1*a;*

FIG. 1*a* is a perspective view of the apparatus 100 according to a preferred embodiment of the invention. As seen in FIG. 1*a*, the apparatus 100 includes a display 101, a power button 102, a front fixed member 103, and a back moveable member 104. The back movable member 104 can move laterally, longitudinally, vertically, and in a rotational movement. FIG. 1*b* is an exploded perspective view of the apparatus 100 of FIG. 1*a*, and shows the detail of the mechanics of the back movable member 104. The front fixed member 103 or back moveable member 104 can be a rubberized surface and configured to minimize point pressure on a user's hand.

As seen in FIG. 1*b*, the back movable member 104 is preferably connected to the apparatus 100 by means of flexible members 105, 106 and 107, preferably three (3) flexible members, an upper flexible member 105, a center flexible member 106 and a lower flexible member 107. According to a preferred embodiment, the flexible members 105, 106 and 107 may be elastic polymers in the nature of bumpers. However, the flexible member(s) 105, 106 and 107 can be any compressible structure (e.g., spring, air bladder, encapsulated fluid) known to those skilled in the art.

Figure 2:
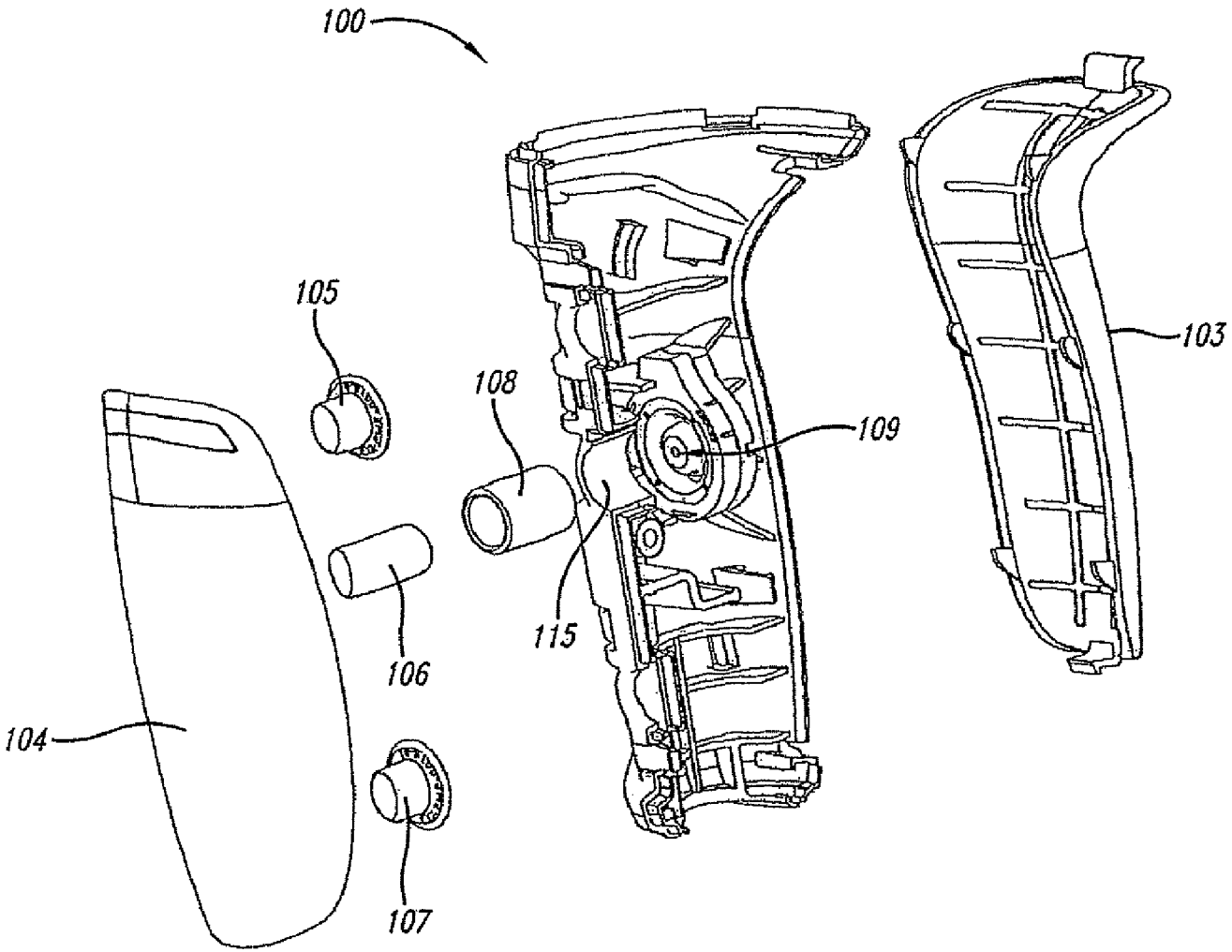
FIG. 2 is an exploded perspective view of the apparatus of FIG. 1*a;*

The center flexible member 106 is preferably provided with a sleeve 108 as seen in FIG. 1*b*, which functions to translate a multiaxial force, as may be applied to the back movable member 104 when a rotated grip is applied to the apparatus 100, into a uniaxial force. Although the sleeve 108 may not translate such force with complete accuracy, the sleeve 108 also helps minimize other possible transfer losses that can occur when the center flexible member 106 expands (widens) under load. The sleeve 108 further provides a hard surface for connecting the force applied to the back movable member 104 to the sensor 109 in the apparatus 100. According to a preferred embodiment, the sleeve 108 is a metal sleeve. FIG. 2 is an exploded perspective view of the apparatus 100 of FIG. 1*a* and shows the detail of the mechanics of the front fixed member 103.

Figure 3B:
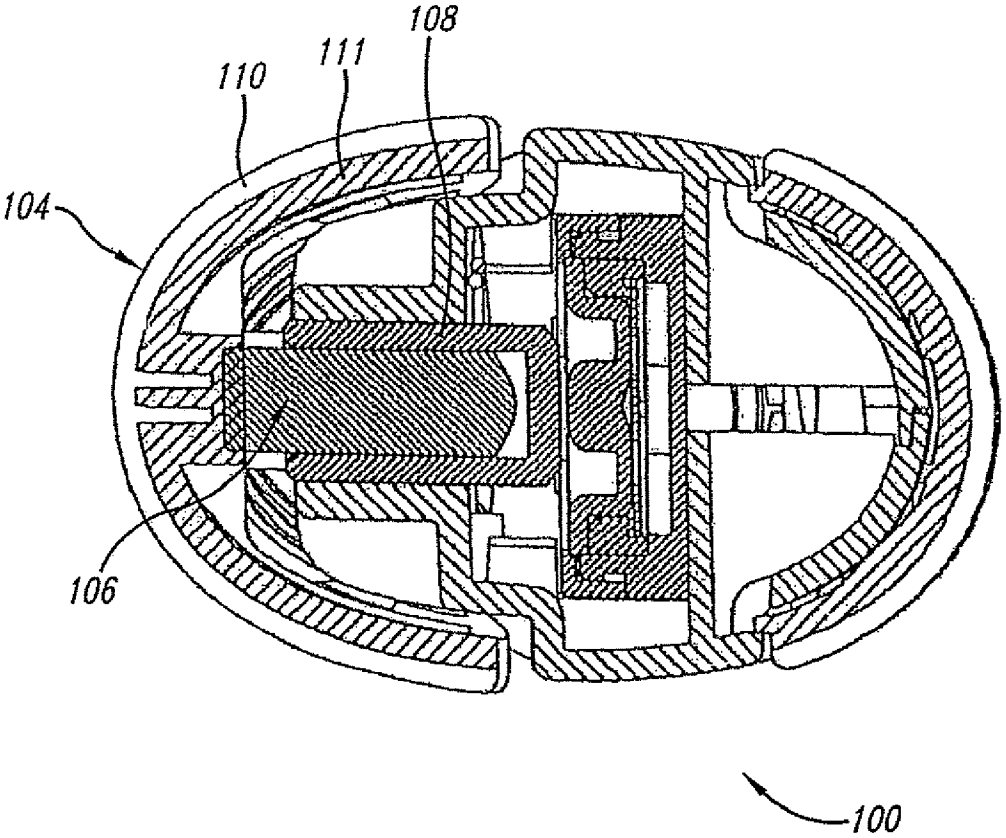
FIG. 3*b* is a sectional view of the apparatus of FIG. 3*a* taken along line 3*b*-3*b;*
Figure 3A:
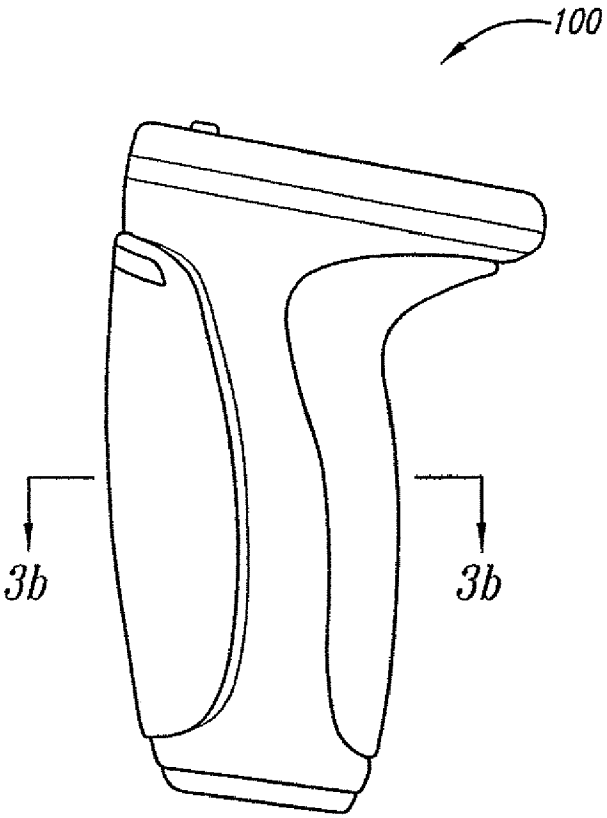
FIG. 3*a* is a side view of the apparatus of FIG. 1*a;*

FIG. 3*a* is a side view of the apparatus 100 of FIG. 1*a* and FIG. 3*b* is a sectional view of the apparatus 100 of FIG. 3*a* taken along line 3*b*-3*b*. As can be seen from FIG. 3*b*, the center flexible member 106 of the apparatus 100 is encased by the sleeve 108. The back movable member 104 is further comprised of a soft shell 110 and a rigid core 111, as illustrated in FIG. 3*b*.

Figure 4B:
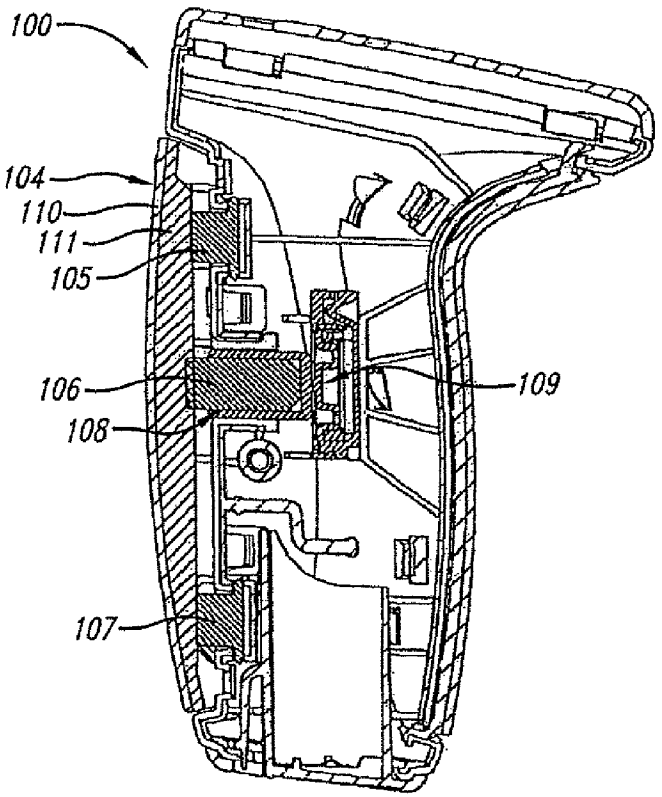
FIG. 4*b* is a sectional view of the apparatus of FIG. 4*a* taken along line 4*b*-4*b;*
Figure 4A:
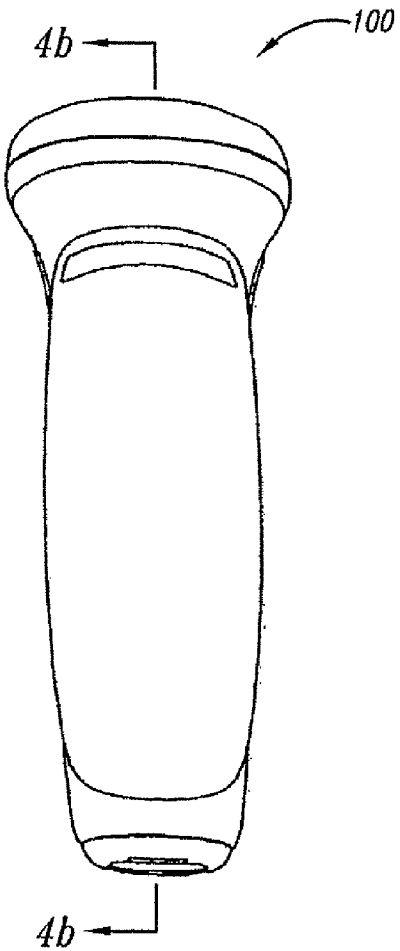
FIG. 4*a* is a back view of the apparatus of FIG. 1*a;*

FIG. 4*a* is a back view of the apparatus 100 of FIG. 1*a* and FIG. 4*b* is a sectional view of the apparatus 100 of FIG. 4*a* taken along line 4*b*-4*b*. FIG. 4*b* also shows the soft shell 110 and rigid core 111 of the back movable member 104.

Figure 5B:
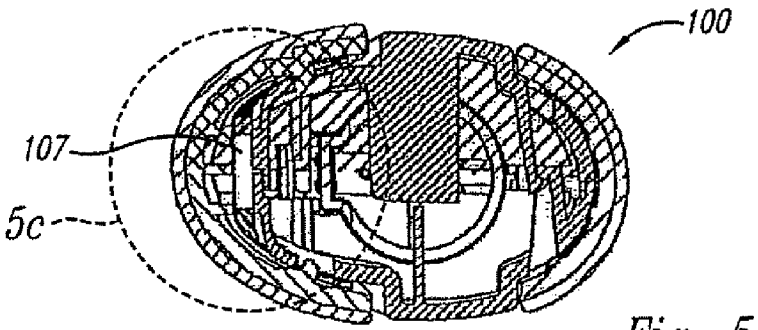
FIG. 5*b* is a sectional view of the apparatus of FIG. 5*a* taken along line 5*b*-5*b;*
Figure 5C:
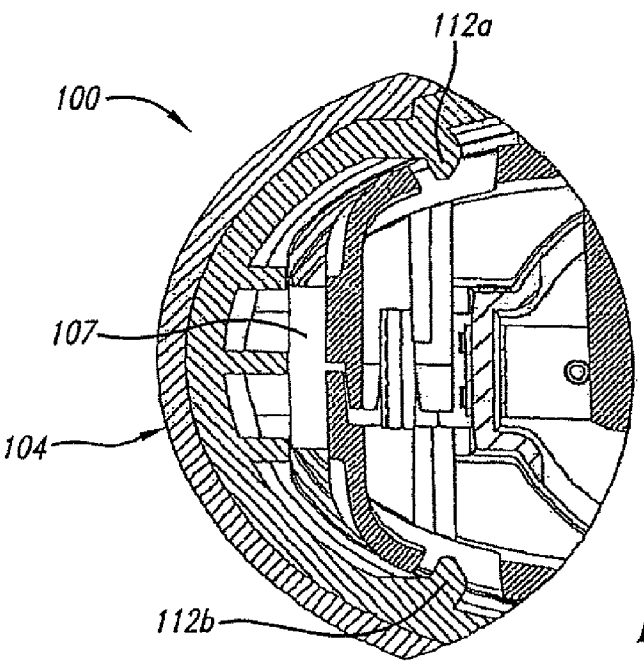
FIG. 5*c* is an enlargement of detail 5*c* of FIG. 5*b;*
Figure 5A:
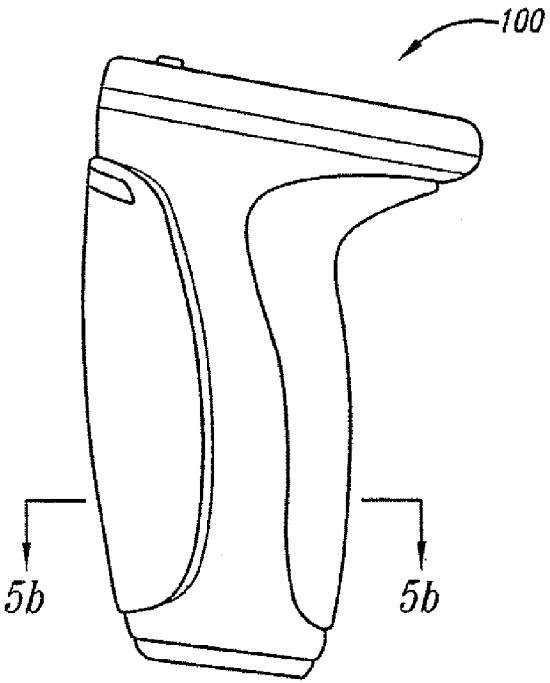
FIG. 5*a* is a side view of the apparatus of FIG. 1*a;*

FIG. 5*a* is a side view of the apparatus 100 of FIG. 1*a* and FIG. 5*b* is a sectional view of the apparatus 100 of FIG. 5*a* taken along line 5*b*-5*b*, i.e., intersecting the lower flexible member 107. FIG. 5*c* is an enlargement of detail 5*e* of FIG. 5*b* and shows the lower snaps (both right 112*a* and left 112*b*) in the relief position, i.e., when no squeeze force is applied to the apparatus 100 and the back movable member 104 is in a resting position.

Figure 6B:
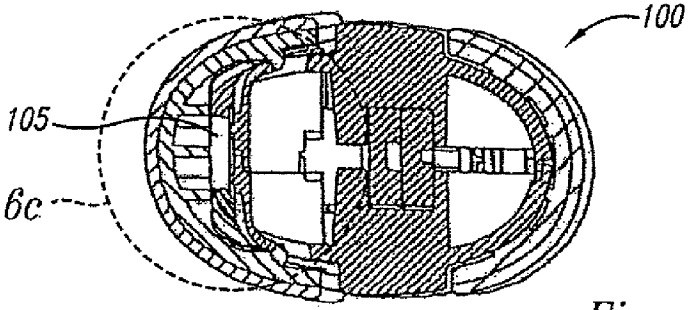
FIG. 6*b* is a sectional view of the apparatus of FIG. 6*a* taken along line 6*b*-6*b;*
Figure 6C:
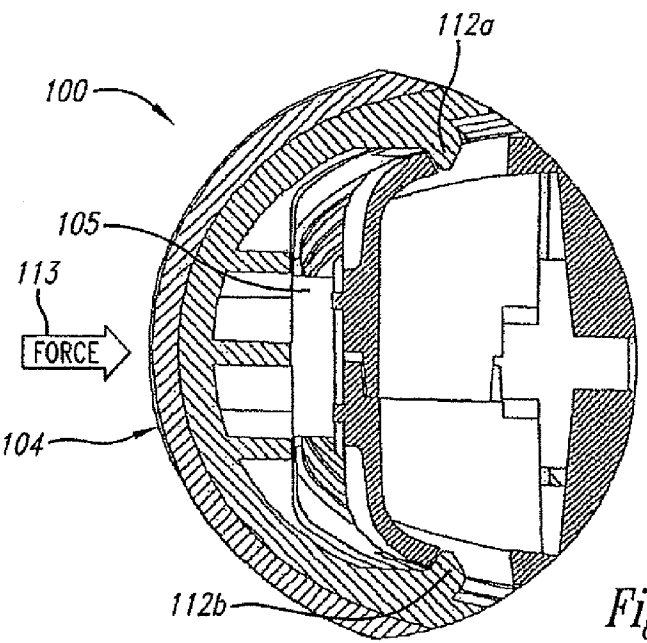
FIG. 6*c* is an enlargement of detail 6*c* of FIG. 6*b;*
Figure 6A:
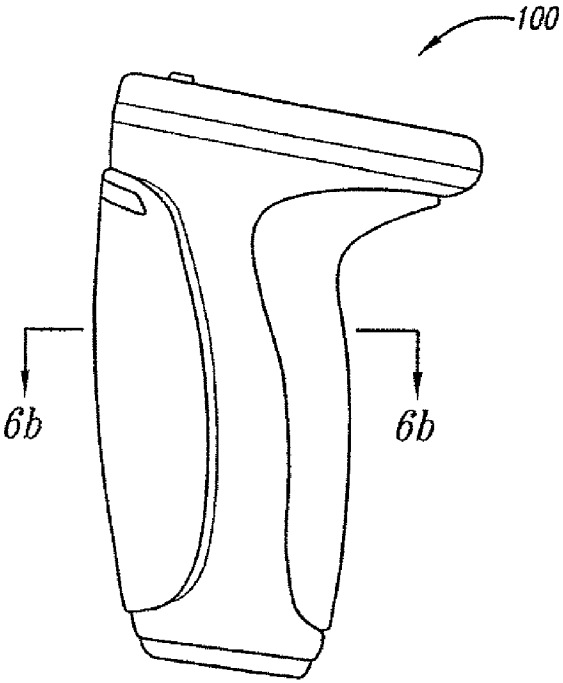
FIG. 6*a* is a side view of the apparatus of FIG. 1*a;*

FIG. 6*a* is a side view of the apparatus 100 of FIG. 1*a* and FIG. 6*b* is a sectional view of the apparatus 100 of FIG. 6*a* taken along line 6*b*-6*b*, i.e., intersecting the upper flexible member 105. FIG. 6*c* is an enlargement of detail 6*c* of FIG. 6*b* and shows the upper snaps (both right 112*a* and left 112*b*) in the stop position, i.e., in a situation where a squeezing force 113 has been applied to the apparatus 100 such that the back movable member 104 has been depressed and the upper flexible member 105 is compressed. When a squeeze force 113 is applied to the apparatus 100, the back movable member 104 pushes up against the upper flexible member 105. Although not pictured in FIG. 6*c*, in the preferred embodiment, the center flexible member 106 comes into contact with the sensor 109 by means of the sleeve 108 when force 113 is applied.

Figure 7B:
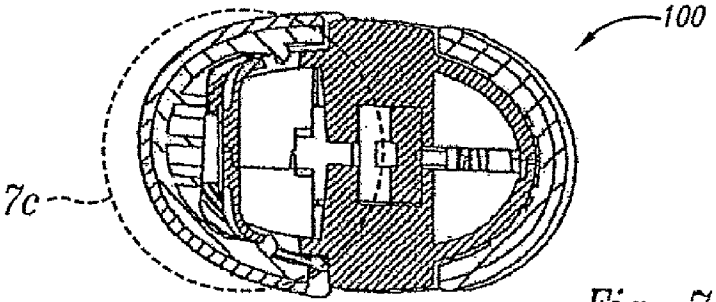
FIG. 7*b* is a sectional view of the apparatus of FIG. 7*a* taken along line 7*b*-7*b;*
Figure 7C:
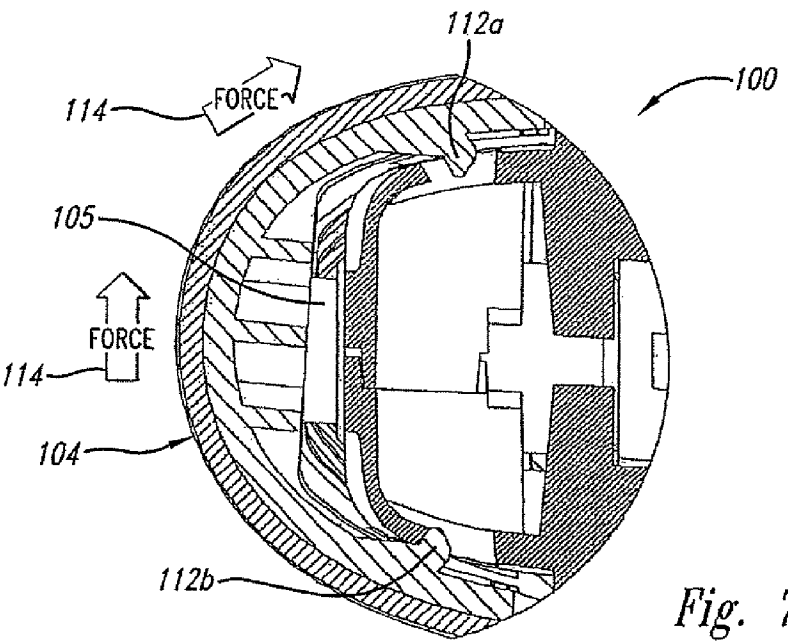
FIG. 7*c* is an enlargement of detail 7*c* of FIG. 7*b;*
Figure 7A:
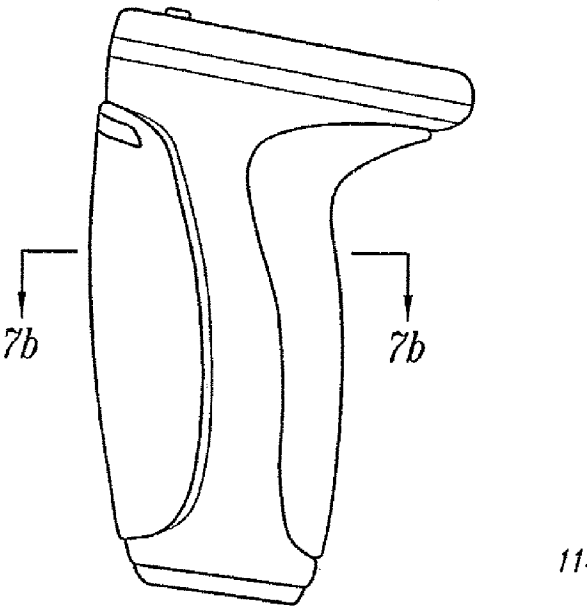
FIG. 7*a* is a side view of the apparatus of FIG. 1*a;*

FIG. 7*a* is a side view of the apparatus 100 of FIG. 1*a* and FIG. 7*b* is a sectional view of the apparatus 100 of FIG. 7*a* taken along line 7*b*-7*b*. FIG. 7*c* is an enlargement of detail 7*c* of FIG. 7*b* and shows the upper snaps (both right 112*a* and left 112*b*) in the stop position in the event that a rotating squeeze force 114 has been applied to the apparatus 100 such that the back movable member 104 has rotated slightly. When such a rotating squeeze force 114 is applied to the apparatus 100, the back movable member 104 pushes up unevenly against the upper flexible member 105 so that, as seen in FIG. 7*c* where the rotational force 114 is to the right, the right snap 112*a* is in the relief position and the left snap 112*b* is in the stop position. In the event that the back movable member 104 is rotated up or down, a vertical rather than horizontal displacement of the back movable member 104 relative to the apparatus 100 would be noted (not shown). The flexible members 105, 106 and 107 and/or back movable member 104 may collectively act as force shunt. However, in the preferred embodiment, only the force transfer member (described as "center flexible member" 106) directly translates the force to the sensor 109.

Referring to FIG. 4*b*, during an exercise regimen, the user exerts a grip force on the apparatus 100. A force proportional to the grip force is transferred via the back movable member 104, the center flexible member 106 and the sleeve 108 to the sensor 109 and measured by the control system of the apparatus 100. The sensor 109 is seated in the body of the apparatus 100. According to a preferred embodiment, for additional grip support, two additional flexible members (upper 105 and lower 107) are seated in the apparatus 100.

For comfort, both the fixed front member 103 and the back movable member 104 are provided with a soft shell 110, preferably a polymer shell, covering a rigid core 111, preferably a polymer core, as seen in FIG. 3*b*. The rigid core 111 also can consist of a metal or a natural fiber. The soft polymer shell 110 is the surface that interfaces with the hand of the user. The soft polymer shell 110 can also consist of a synthetic (e.g., rubber or foam) or a natural fiber. Furthermore, comfort is also ensured by virtue of the flexible members, including the upper 105, center 106 and lower 107 flexible members, which provide a "springy" feel to the apparatus 100 and ensure greater comfort and accordingly, greater compliance with the exercise regimen. Compliance is further accomplished by allowing the back movable member 104 to displace (travel a certain distance) towards the apparatus 100 when a squeeze force is applied. Displacement of the back movable member 104 towards the apparatus 100 is achieved by means of the flexible members 105, 106 and 107 and by allowing a gap to exist between back movable member 104 and the apparatus 100. Friction between the apparatus 100 and the flexible members 105, 106 and 107 can be reduced by housing, wholly or partially, any of the flexible members in a corresponding sleeve (e.g., 108). Use of a sleeve may also serve to limit the range of motion of the flexible member housed therein.

As mentioned above, additional comfort is provided during isometric exercise by allowing a certain amount of right/left and/or up/down rotational movement of the back movable member 104. Right/left rotation is accomplished by placing the flexible members 105, 106 and 107 along the centerline of the back movable member 104. Right/left rotational freedom can be further facilitated by providing clearance cuts behind the snaps 112*a* and 112*b* in the apparatus 100. Up/down rotation is accomplished by the elastic nature of the upper and lower flexible members 105, 106 and 107. Up/down rotational freedom may be further facilitated by providing clearance cuts behind the snaps 112*a* and 112*b* in apparatus 100. Housing the center flexible member 106 in a sleeve 108 ensures that the force applied to the back movable member 104 is always centered and perpendicular to the sensor 109 surface in case of rotated grip positions either left/right and/or up/down.

The center flexible member 106 is seated in the sleeve 108 and the sleeve 108 is in turn seated in the apparatus 100 and tightly guided by a sleeve guide 115 as seen in FIG. 2. The arrangement of the center flexible member 106, sleeve 108 and sleeve guide 115 supports the force transfer to the sensor 109 with minimum possible friction losses that may occur as a result of deformation of the flexible members 105, 106 and 107 or grip rotation.

Figure 12:
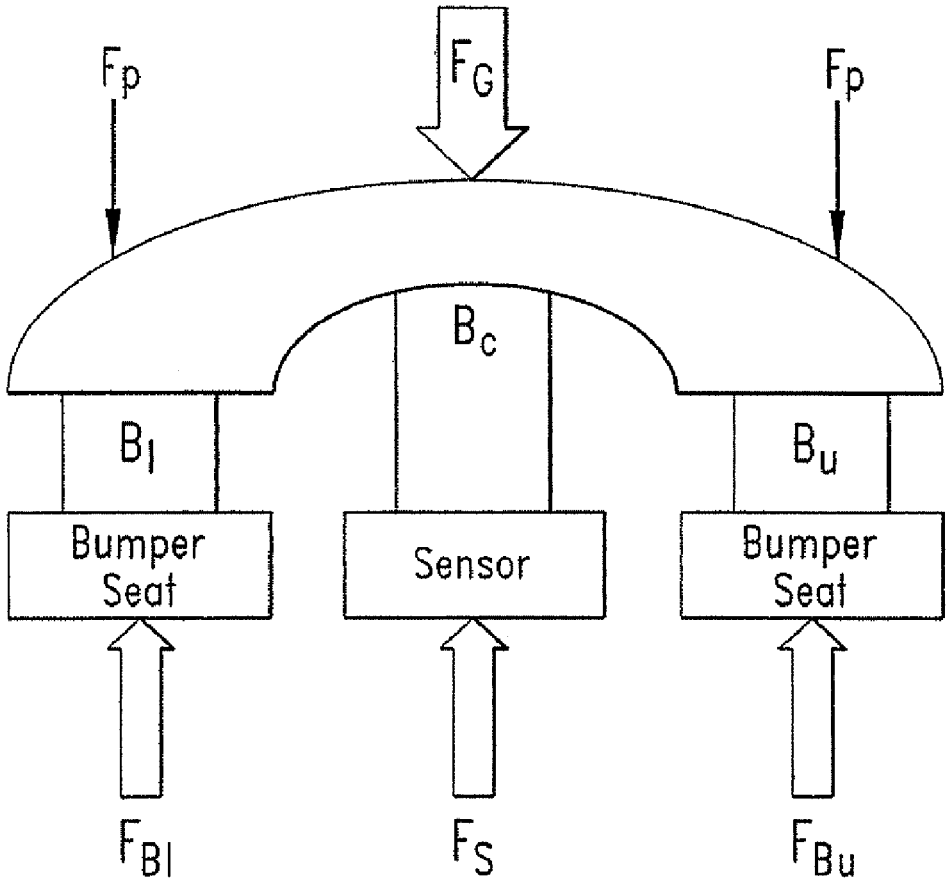
FIG. 12 is a schematic of the force transfers.

In use, the grip force applied to the back movable member 104 is transferred through the center 106, lower 107 and upper 105 flexible members. Therefore, only a proportional fraction of the actual grip force is directly transferred to the sensor by the center flexible member 106. FIG. 12 is a schematic showing the force transfers, including the loads present in the apparatus of the present invention. Due to the relative short duration of the applied squeeze force, creep or setting of the force transmitting flexible member, i.e., the center elastomer bumper 106, can be considered negligible. Therefore, based on FIG. 12, the force equilibrium can be described as follows:

$$F_G=F_{Bl}+F_S+F_{Bu}-2F_P \quad \text{(Eq. 1)}$$

$$F_{Bl}+F_{Bu}=c'F_S \quad \text{(Eq. 2),}$$

wherein $c'$ is a fractional constant

Accordingly, Eq. 1 can be rewritten as:

$$F_G=F_S+c'F_S-2F_P=F_S(1+c')-2F_P \quad \text{(Eq. 3)}$$

Eq. 3 can again be rewritten as:

$$F_G=C_t'F_S-2F_P \quad \text{(Eq. 4),}$$

$$\text{if } C_t'=(1+c') \quad \text{(Eq. 5)}$$

The force $F_S$ transmitted to the sensor is then:

$$F_S=(F_G+2F_P)/C_t' \quad \text{(Eq. 6)}$$

Eq. 6 can be rewritten as:

$$F_S=C_t(F_G+2F_P) \quad \text{(Eq. 7),}$$

$$\text{if } C_t=1/C_t' \quad \text{(Eq. 8),}$$

wherein $C_t$ is the force transfer factor.

The force transfer factor $C_t$ of the entire system is determined by experimentation, and then implemented in the code that calculates the grip force from the sensor output voltage. $F_P$ varies due to manufacturing and material related factors. Furthermore, $F_P$ can change during initial usage of the device (break-in period). In order to ensure force measurements of sufficient accuracy and reproducibility, $F_P$ is measured by the electronics of the device prior to each use, and electronically set to zero.

Figure 8:
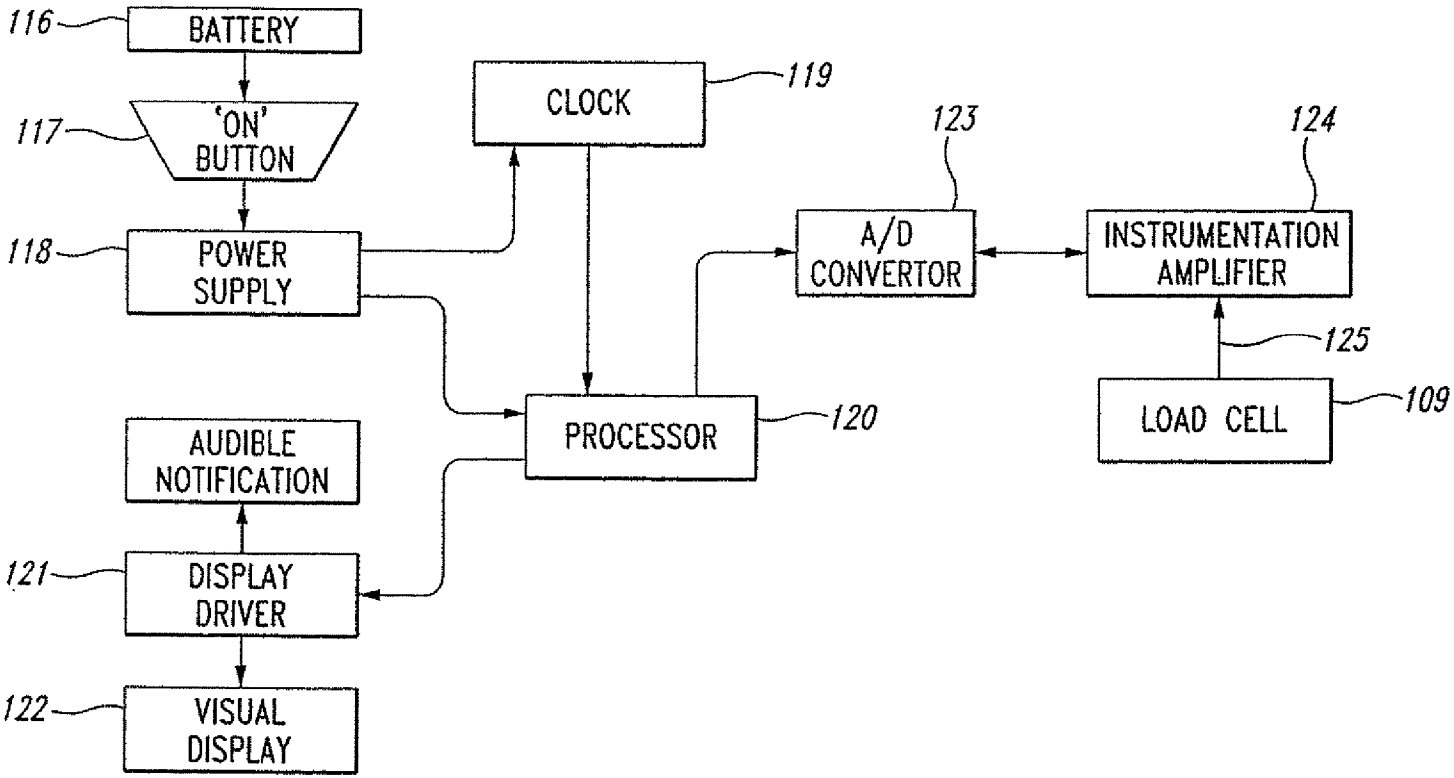
FIG. 8 is a block diagram of the hardware employed with the apparatus of FIG. 1*a;*

FIG. 8 is a block diagram of the hardware employed with the preferred apparatus 100 of FIG. 1*a*. As can be seen in FIG. 8, battery 116 communicates through the control system power button 117, i.e., the "on" button, which in turn activates the power supply 118. The power supply 118 powers a timing device 119, preferably an oscillator such as a clock. The power supply 118 also powers the processor 120 portion of the control system, which in turn controls a user interface driver 121 (display driver) that provides an audible notification, i.e., a buzzer, and/or a visual display 122, i.e., a liquid crystal display. The control system also employs an analog to digital converter (A/D converter) 123 that converts the force applied to the sensor 109 from analog to digital, i.e., binary number. The A/D converter 123 communicates with amplifier 124 that amplifies the output signal 125 from the load cell, i.e., the sensor 109. Thus, as a force is applied to the device, the dynamometer portion of the control system converts the force applied from a mechanical force into a form useable by the processor 120 for user feedback and guidance.

Figure 9:
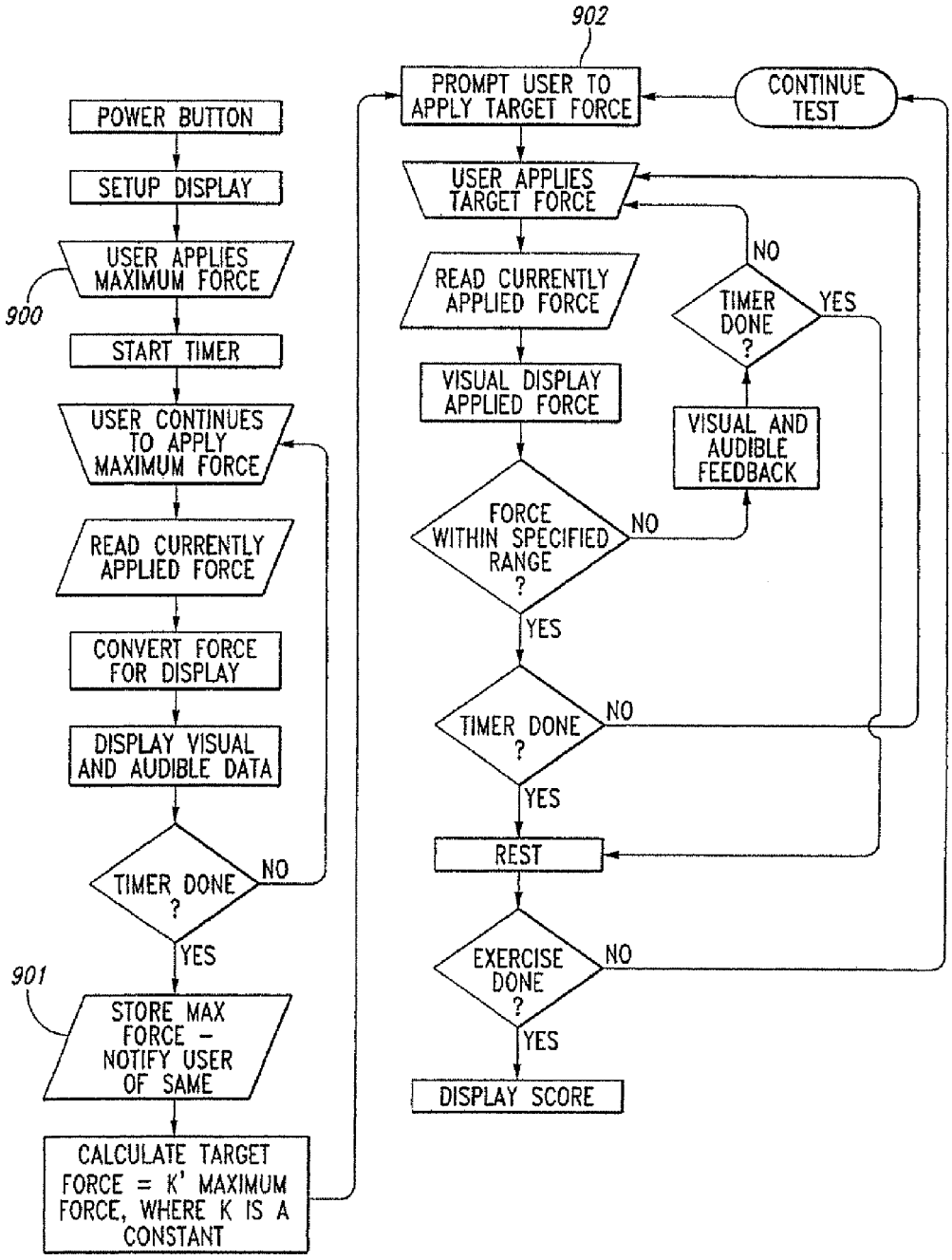
FIG. 9 is a flowchart showing a procedure employed by the apparatus of FIG. 1*a;*

FIG. 9 is a flowchart showing a procedure employed by the apparatus 100 of FIG. 1*a*. As seen in FIG. 9, once the user has applied the maximum squeeze force 900, the apparatus records the maximum squeeze force as a relative number and displays this number on the display 901. The user is then prompted to apply a fractional force 902, which is a percentage of the maximum force. According to a preferred embodiment, the fractional force is about 15% to about 60%, preferably about 25% to about 55%, and more preferably about 30% if the time period of the exercise is longer, i.e., 12 minutes, and more preferably about 50% if the time period of the exercise is shorter, i.e., 7 or 8 minutes. As seen in FIG. 9, the constant "K" is the fractional force.

Figure 10:
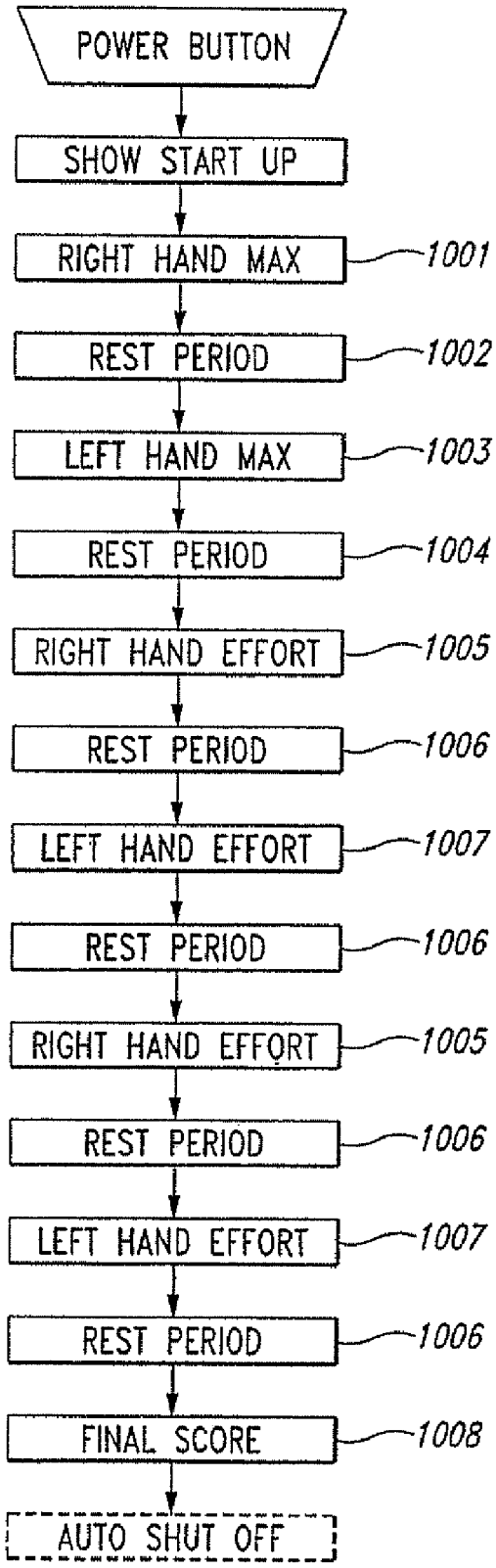
FIG. 10 is a flowchart showing an exercise regimen carried out by the apparatus of FIG. 1*a;*

FIG. 10 is a flowchart showing an exercise regimen carried out by the apparatus 100 of FIG. 1*a*, wherein maximum squeeze force is measured on the right hand first 1001, followed by a rest period 1002. Then the maximum squeeze force is measured on the left hand 1003, followed by a rest period 1004. Then the right hand and left hand are alternatively used to squeeze to a fractional force 1005 and 1007, with rest periods 1006 between each fractional squeeze force effort 1005 and 1007. According to a preferred embodiment, the right and left hand are alternated to a fractional squeeze force for at least about two (2) repetitions and for at most about five (5) repetitions. According to the present invention, the higher the number of repetitions, the lower the fractional force exerted should be. Likewise, the longer amount of time the fractional squeeze force is held, the lower the fractional squeeze force may be. In a preferred embodiment, the final score 1008 is an average of the right hand and left hand maximum squeeze force 1001 and 1003. It is understood, however, that the exercise could be started with the left hand instead of the right hand, as long as each hand is alternated during the exercise regimen.

Figure 11A:
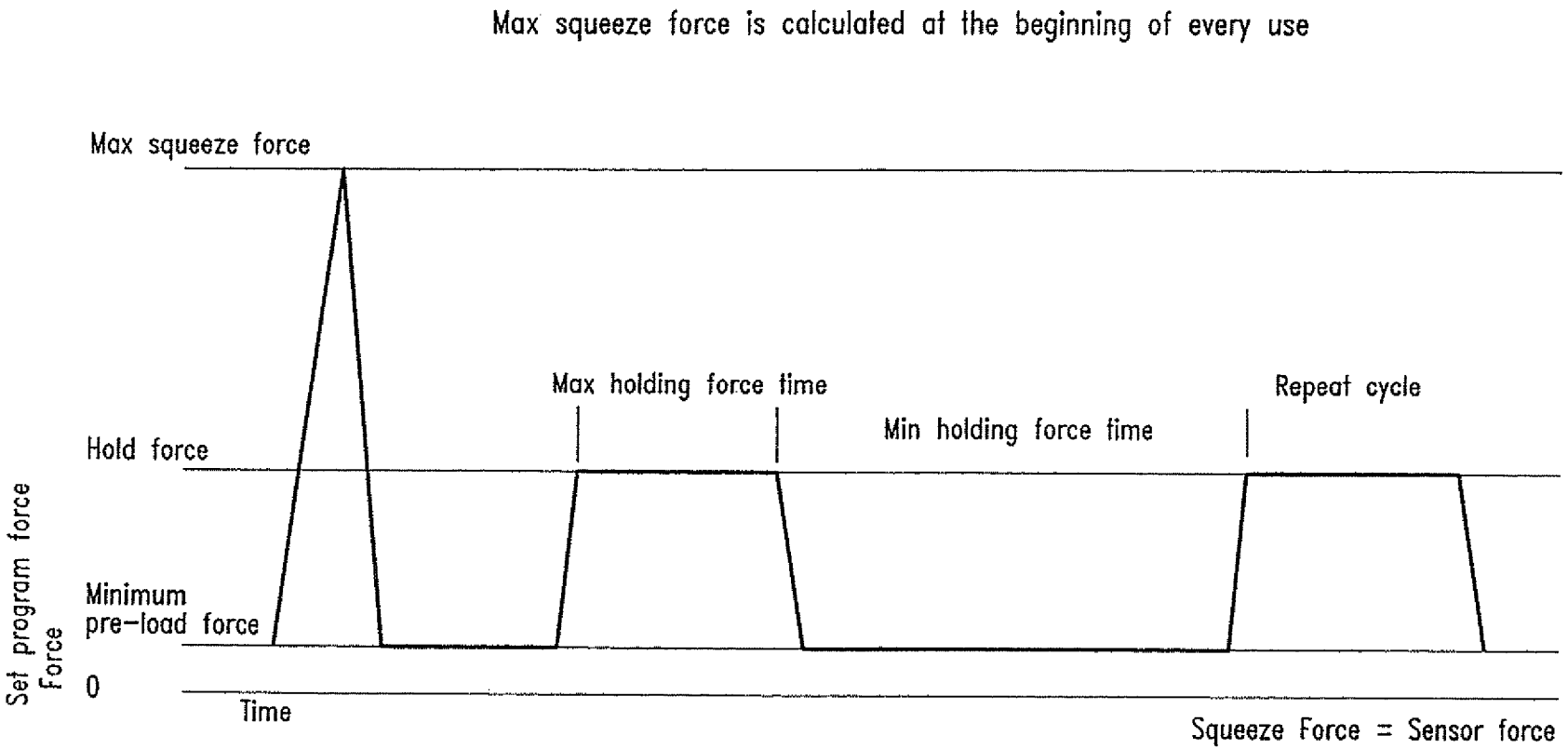
FIG. 11*a* is a graph displaying the force applied to the apparatus of FIG. 1*a* pursuant to an exercise regimen.
Figure 11B:
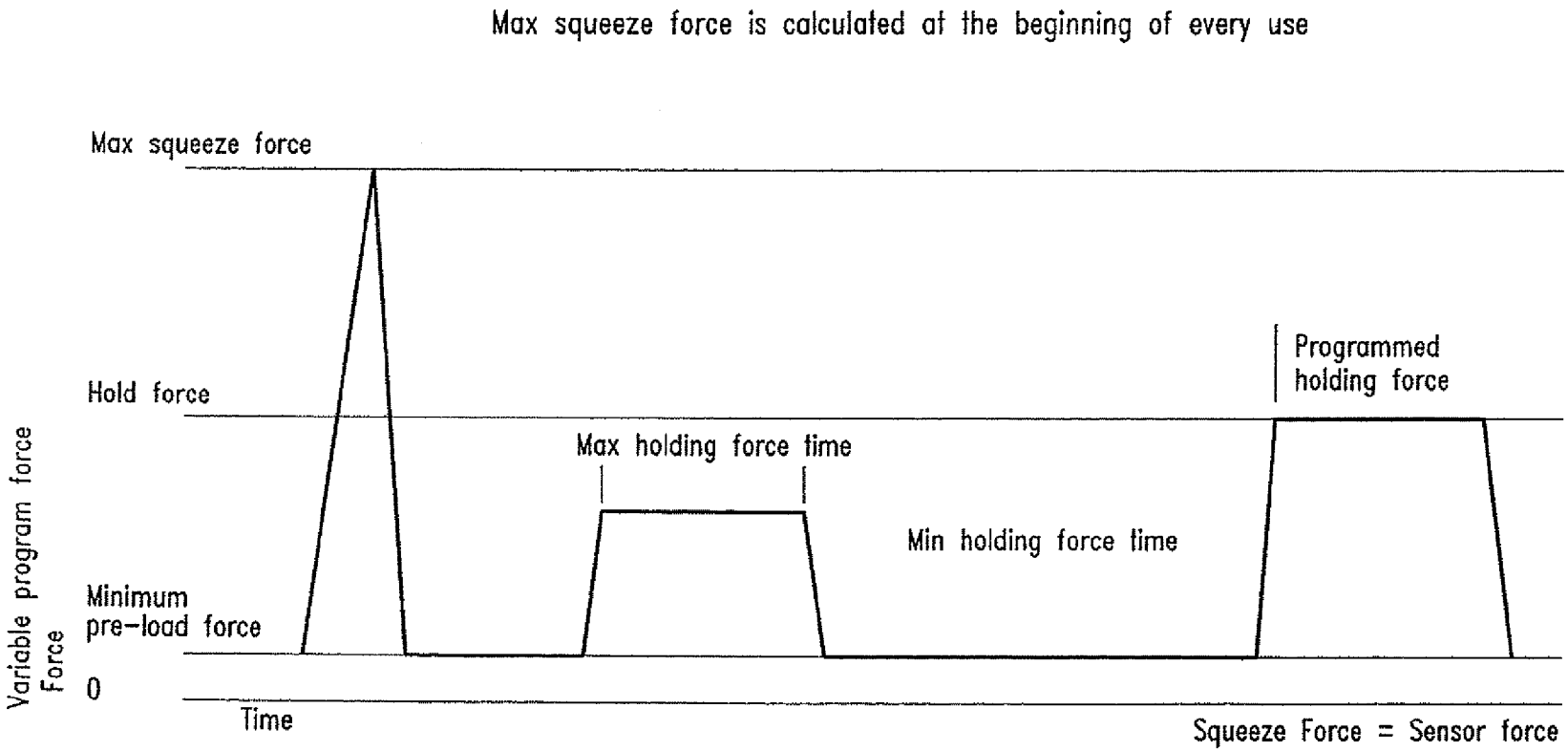
FIG. 11*b* is a graph displaying the force applied to the apparatus of FIG. 1*a* pursuant to an exercise regimen wherein the force is variable.

FIG. 11*a* is a graph displaying the force applied to the apparatus 100 of FIG. 1*a* pursuant to an exercise regimen and FIG. 11*b* is a graph displaying the force applied to the apparatus 100 of FIG. 1*a* pursuant to an exercise regimen wherein the force is variable. As seen in FIGS. 11*a* and 11*b*, in each case, the resting squeeze force (RSF) is preferably zero.

Example 1

12 minute protocol, wherein the fractional squeeze force is about 28% to about 35% of the maximum squeeze force, preferably about 30%.

TABLE 1

| | Time |
|---|---|
| Maximum squeeze force, first hand | 3 seconds |
| Rest | 10 seconds |
| Maximum squeeze force, second hand | 3 seconds |
| Rest | 10 seconds |
| Fractional squeeze force, first hand | 2 minutes |
| Rest | 1 minute |
| Fractional squeeze force, second hand | 2 minutes |
| Rest | 1 minute |
| Fractional squeeze force, first hand | 2 minutes |
| Rest | 1 minute |
| Fractional squeeze force, second hand | 2 minutes |
| End of exercise | |

Example 2

7 minute protocol, wherein the fractional squeeze force is about 35% to about 55% of the maximum squeeze force, preferably about 50%.

TABLE 2

| | Time |
|---|---|
| Maximum squeeze force, first hand | 3 seconds |
| Rest | 10 seconds |
| Maximum squeeze force, second hand | 3 seconds |
| Rest | 10 seconds |
| Fractional squeeze force, first hand | 90 seconds |
| Rest | 1 minute |
| Fractional squeeze force, second hand | 90 seconds |
| Rest | 1 minute |
| Fractional squeeze force, first hand | 90 seconds |
| Rest | 1 minute |
| Fractional squeeze force, second hand | 90 seconds |
| End of exercise | |

Having now described a few embodiments of the invention, it should be apparent to those skilled in the art that the foregoing is merely illustrative and not limiting, having been presented by way of example only. Numerous modifications and other embodiments are within the scope of the invention and any equivalent thereto. It can be appreciated that variations to the present invention would be readily apparent to those skilled in the art, and the present invention is intended to include those alternatives.

The apparatus of the present invention may be used to carry out an exercise regimen that lowers the resting systolic and diastolic blood pressures of users. A method of the present invention is also provided for lowering the resting systolic and diastolic blood pressures of users as well as providing a protocol for increasing parasympathetic nerve activity and improving peripheral artery function. The protocol also adds to a person's nitric oxide production.

Advantages of the present invention include recognition that isometric exercise is an effective means for a patient, i.e. user, to lower both resting systolic and diastolic blood pressure. Another advantage of the present invention is that lowering resting blood pressure can be achieved utilizing isometric contractions far short of maximal force. Isometric contractions at maximum force could cause blood pressure to rise to dangerous levels, especially in hypertensive patients. Yet another advantage is an isometric exercise regimen that takes but a few minutes a day and yet is effective in lowering the user's resting blood pressure.

In addition to lowering the user's resting blood pressure, it has been found that an inherent aspect of the method of the invention is that the method restricts blood flow when the user squeezes the apparatus at the fractional squeeze force (FSF). The restricted blood flow reduces localized necrosis due to obstruction of blood supply, such as which may be experienced by a user during a future event. According to one exemplary embodiment, when the user squeezes the apparatus at the fractional squeeze force (FSF) for a time such as T1, blood flow will be restricted during that time T1.

Further, since numerous modifications will readily occur to those skilled in the art, it is not desired to limit the invention to the exact construction and operation illustrated and described, and accordingly, all suitable modifications and equivalents may be resorted to as falling within the scope of the invention.

What is claimed is:

1. A method for lowering the resting systolic and diastolic blood pressures of a user comprising the following steps:

a) measuring a maximum squeeze force (MSF) of a muscle or muscle group of said user;

b) inputting an amount of time said user has available (T);

c) calculating a fractional squeeze force (FSF) based upon said maximum squeeze force (MSF) and said amount of time said user has available (T);

d) directing said user to squeeze to said fractional squeeze force (FSF) for a period of time (T1);

e) directing said user to squeeze to a resting squeeze force (RSF) for a second period of time (T2), wherein said resting squeeze force (RSF) is zero or not zero;

f) repeating steps (d) and (e); and g) returning to said fractional squeeze force (FSF) for said second period of time (T2).

2. The method of claim 1, further comprising, after said step g), directing said user to a zero squeeze force (ZSF).

3. The method of claim 1, wherein said method allows for the change of said MSF, FSF, RSF, or T during a performance of an exercise.

4. The method of claim 1, wherein said step a) comprises measuring said maximum squeeze force (MSF) of one or both of said user's hands.

5. The method of claim 1, wherein the steps of directing said user comprise directing said user with at least one of audio, visual and tactile prompts.

6. The method of claim 1, wherein said method restricts blood flow and reduces localized necrosis due to obstruction of blood supply.

7. The method of claim 6, wherein said method restricts said blood flow during each said period of time (T1).

8. The method of claim 1, wherein said step f) of repeating steps (d) and (e) comprises repeating said steps (d) and (e) for said amount of time said user has available (T).

9. The method of claim 1, wherein said step f) of repeating steps (d) and (e) comprises repeating said steps (d) and (e) for a set number of repetitions (R).

10. The method of claim 1, wherein said fractional squeeze force (FSF) is variable.

11. The method of claim 1, wherein said muscle or muscle group comprises said user's hand muscles, step (a) comprises measuring said maximum squeeze force (MSF) of said user's hand muscles as a function of time (t) and further comprising recording said maximum squeeze force as a function of time (MSF/t).

12. A method for lowering the resting systolic and diastolic blood pressures of a user comprising the following steps:

a) measuring a maximum squeeze force (MSF) of a muscle or muscle group of said user;

b) inputting a level of force (LF);

c) calculating a fractional squeeze force (FSF) based upon said maximum squeeze force (MSF) and said level of force (LF);

d) directing said user to squeeze to said fractional squeeze force (FSF) for a period of time (T1);

e) directing said user to squeeze to a resting squeeze force (RSF) for a second period of time (T2), wherein the resting squeeze force (RSF) is zero or not zero;

f) repeating steps (d) and (e) for an amount of time (T); and g) returning to said fractional squeeze force (FSF) for said second period of time (T2).

13. The method of claim 12, further comprising, after said step g), directing said user to a zero squeeze force (ZSF).

14. The method of claim 12, wherein said method allows for the change of said MSF, FSF, RSF, or T during a performance of an exercise.

15. The method of claim 12, wherein said step a) comprises measuring said maximum squeeze force (MSF) of one or both of said user's hands.

16. The method of claim 12, wherein said steps of directing said user comprise directing said user with at least one of audio, visual and tactile prompts.

17. The method of claim 12, wherein said method restricts blood flow and reduces localized necrosis due to obstruction of blood supply.

18. The method of claim 17, wherein said method restricts said blood flow during each said period of time (T1).

19. The method of claim 12, wherein said step (f) comprises repeating said steps (d) and (e) for a set number of repetitions (R).

20. The method of claim 12, wherein said muscle or muscle group comprises said user's hand muscles, step (b) comprises measuring said maximum squeeze force (MSF) of said user's hand muscles as a function of time (t) and further comprising recording said maximum squeeze force as a function of time (MSF/t).

21. A method for lowering the resting systolic and diastolic blood pressures of a user comprising the following steps:

a) selecting an exercise regimen;

b) measuring a maximum squeeze force (MSF) of said user's hand;

c) inputting one of an amount of time said user has available (T), and a level of force (LF) said user wants to exert;

d) selecting a fractional squeeze force (FSF) for said exercise regimen;

e) directing said user to squeeze to said fractional squeeze force (FSF) for a period of time (T1);

f) directing said user to squeeze to a resting squeeze force (RSF) for a second set period of time (T2), wherein said resting squeeze force (RSF) is zero or not zero;

g) repeating steps (e) and (f); and h) directing said user to a zero squeeze force (ZSF).

22. The method of claim 21, further comprising, between said steps g) and h), returning to said fractional squeeze force (FSF) for said second period of time (T2).

23. The method of claim 21, wherein said method for lowering the resting systolic and diastolic blood pressures of a user restricts blood flow and reduces localized necrosis due to obstruction of blood supply.

24. The method of claim 23, wherein said method restricts said blood flow during each said set period of time (T1).

25. The method of claim 21, wherein said selecting a fractional squeeze force (FSF) for said exercise regimen comprises calculating said fractional squeeze force (FSF) for said exercise regimen based on said maximum squeeze force (MSF) and one of said amount of time said user has available (T), and said level of force (LF) said user wants to exert.

* * * * *